United States Patent [19]

Bridgehouse et al.

[11] 4,359,859

[45] Nov. 23, 1982

[54] TWINE FORMED OF CORN HUSKS AND LEAVES

[75] Inventors: E. Scott Bridgehouse; William M. Hawthorne, both of Lancaster, Pa.

[73] Assignee: Maize-Tech, Inc., Lancaster, Pa.

[21] Appl. No.: 188,186

[22] Filed: Sep. 18, 1980

[51] Int. Cl.[3] ..... D02G 3/02; D01B 1/10; D01B 1/42

[52] U.S. Cl. ..... 57/200; 19/7; 19/8

[58] Field of Search ..... 57/200, 258, 2, 7, 292, 57/295–298, 210, 236, 238, 252, 256, 259, 260; 19/7, 8

[56] References Cited

U.S. PATENT DOCUMENTS

| | | | |
|---|---|---|---|
| 234,641 | 11/1880 | Wright | 19/7 X |
| 279,435 | 6/1883 | Roberts | 19/8 |
| 1,277,185 | 8/1918 | Brown | 19/7 |
| 2,070,273 | 2/1937 | Haughey | 19/7 |
| 2,128,929 | 9/1938 | Estes | 57/200 |
| 2,151,952 | 3/1939 | Wasum | 57/258 X |
| 4,233,808 | 11/1980 | Gieske | 57/260 X |

*Primary Examiner*—Donald Watkins

*Attorney, Agent, or Firm*—Caesar, Rivise, Bernstein & Cohen, Ltd.

[57] ABSTRACT

The extraction of fibres from corn husks and/or leaves or corn husks alone is accomplished to provide fibres which are substantially free of the vegetable binder material. The corn husks (and leaves) are preferably allowed to dry to a substantially moisture-free state and are then soaked in a caustic solution for a predetermined period in which the caustic solution frees the fibres from the vegetable matter of the corn husks (and leaves) and reacts with the fibre to strengthen the same. Before the caustic material has an opportunity to degrade the fibres of the corn husks (and leaves), the caustic solution is diluted by rinsing the corn husks (and leaves). While still wet, the fibrous material is straightened so as to dispose the fibrous components of the corn husks (and leaves) in substantially parallel arrangement and in the process the excess binder material is separated from the fibrous material. The fibrous material is then permitted to dry and is subjected to a combing action, preferably by processing the material in a woolen carding machine. The combed fibrous material is formed in to a tow or fibre bundle of substantial thickness and this tow bundle is then twisted and drafted to form the end product, i.e., twine. Preferably before twisting, the combed fibrous material is lubricated by passing the tow through a bath of a suitable lubricant, e.g., ethylene glycol, which serves to lubricate the fibres in the tow to permit them to be twisted and drafted into a twine which has substantial strength.

2 Claims, No Drawings

TWINE FORMED OF CORN HUSKS AND LEAVES

The present invention relates to the extraction of fibres from the husks and leaves of the corn plant and has particular application to the manufacture of twine of the character used in agricultural machinery for binding hay and straw into bundles or bales although other uses of the extracted fibre is contremplated. More particularly, the present invention provides a method for making such twine out of domestic by-products of the agricultural operations conducted in the region where the twine is used.

Prior to the present invention, baler twine and the like has been produced from sisal fiber which is grown in the tropical climates and is harvested and processed into fiber with the use of a substantial amount of hand labor which is plentiful in the tropical climates. Attempts to produce sisal products in the United States and in the regions where such twine is widely used have proved uneconomical because of the large amount of labor required to harvest and process the fiber and because of the climate conditions required for high production of the sisal plant.

Attempts have been made to find substitutes for the sisal fiber, but the economics of the production and treatment of the substitute materials to produce twine has been such as to render such substitutes impractical.

The present invention results from the discovery of a novel method for recovering fibrous material from corn plant parts, preferably the husks and leaves in a manner which is highly economical and yet which is fully effective to produce fibrous material which may be formed into twine.

Specifically, the present invention results from the discovery that the fibres in the husks and leaves may be freed from their binding material by soaking the husks and leaves in a caustic solution for a limited period in order to free the fibrous material and then separating the fibrous material from the natural binder for subsequent processing on conventional woolen carding machines or similar combing apparatus.

The use of husks and leaves provides a highly economical source of raw material for the production of twine since in the production of feed corn, the conventional practice is to shuck the corn ears from the corn stalks in the field and to husk the ears concurrently with the harvesting operation with the corn harvesting machine discharging the husks from the corn cobs into the ground where the husks are permitted to lay and subsequently be plowed under when the field has been harvested. The leaves are similarly discarded.

With the foregoing in mind, the present invention enables the by-product of the corn-growing operation, namely, the husks and leaves, which were normally discarded, to be used to produce a useful product.

By reason of this use of material, which is normally wasted, the entire cost of producing the twine in accordance with the present invention resides in the processing operations used to produce the twine.

The present invention provides a method for producing twine in which the husks and leaves are treated to liberate the fibrous components, and these fibrous components are carded to produce a two bundle which may be twisted and drafted to produce a twine.

The twine of the present invention is characterized by its consisting essentially of fibrous material from corn husks and leaves, the material being twisted together, preferably with a small quantity of lubricant, to produce a twine suitable for use in agricultural machinery for binding hay and straw into bundles or bales.

The present invention employs a natural domestic product which is in abundant supply in the region where the end product is needed so as to enable efficient production of the twine and of product.

It is preferred that the husks and leaves be used, although the presence of the corn stalks can also, at times, be tolerated. However, the fibres in the stalk are thicker and more brittle. In this connection, the known prior art deals exclusively with corn stalks and for the purpose of paper manufacture, not for the extraction of fibres and the preferred use of making of twine as in the present invention. See, for instance, U.S. Pat. Nos. 2,029,973, 2,606,114, 2,614,924 and 3,461,028.

The present invention preferably entails the use of corn husks and leaves. The corn plant has long sword-like leaves extending from its stalk at the points where the corn ears grow. The corn ears comprise a cob having kernels normally arranged in uniform rows about the cob. Each kernel has a silk extending lengthwise of the cob beyond the end of the cob. The cob, kernels and silk are enclosed by corn husks which differ from the sword-like leaves although they are leaf-like in form and snuggly encase the kernels with the silk extending beyond the end of the ear. The husks of the ear include a plurality of fibrils or fibrous material extending longitudinally the length of the husk which are bound together to form a thin leaf-like structure by vegetable binding material. At the base of the ear, the husks merge into the stem of the ear which forms part of the cob.

Generally corn is harvested mechanically with a picker that travels along the rows of corn plants and strips the ears from the rest of the plant, removes the husks from the ears and drops the ears into a wagon trailing the harvester. The husks are normally discharged onto the surface of the corn field where it is ploughed under during preparation of the field for the next crop. The plant leaves are similarly discarded.

In accordance with the present invention, the corn husks and leaves are salvaged from the harvesting machine and are deposited in an alkaline bath and allowed to soak for a period of from one to five days at room temperature or elevated temperature. The alkaline bath is preferably in the range of from 5% to 25% sodium hydroxide so as to produce a mild alkaline solution which serves to loosen the long fibrous material from the vegetable matter that normally binds the fibers together in the husk and leaves. The vegetable matter turns into a substance having a gelatinous consistency so that the fibrous material may be separated therefrom. No mechanical chopping action is employed since the length of the fibres in their natural form is most desirable.

At the conclusion of the soaking operation, the caustic solution is diluted for example by the addition of clear water so as to arrest the action of the caustic solution upon the corn husks and leaves. Alternatively, the soaked corn husks and leaves are transferred to a rinse tank where the rinse water serves to dilute the concentration of the caustic carried with the corn husks and leaves, and arrests the action of the caustic solution upon the corn husks and leaves. In either case, the corn husk and leaf material which includes the fibrous material which has been freed by the action of the caustic solution and the residual vegetable matter may be agitated for a period so as to permit the removal of any other foreign material that may be present and excess moisture is expelled or squeezed from the fibrous mass and the fibrous mass is permitted to dry.

When a substantial part of the residual moisture has been expelled from the fibrous material, it is combed to insure separation of the fibrous material from the vegetable matter remaining and to align the fibrous material into substantially parallel array. Preferably, the combing operation comprises feeding the fibrous material into a carding machine, preferably a woolen-type carding machine which has a main carding cylinder with a series of carding rolls disposed at circumferentially spaced rotations about the main cylinder to operate on the fibrous material to straighten the fibers and to dispose them in substantially parallel array on the main cylinder. The carding action on the fibrous material forms a web of the fibrous material on the cylinder wherein the fibers are thoroughly blended with one another to form a relatively coherent web.

The carded web is doffed from the main cylinder and is fed through a funnel-like condenser which consolidates the web into a tow bundle having a thickness or diameter determined by the width of the web formed on the main cylinder as determined the length of the cylinder. Several tow bundles may be doffed from a single cylinder by splitting the web or disposing several doffers in staggered arrangement at the discharge position of the main cylinder, each doffer feeding the web stripped by the doffer into a condenser to form a separate tow bundle.

The tow bundle from the carding machine is then preferably passed through a mass of ethylene glycol which serves to coat the fibers with a lubricating component which facilitates the further processing of the tow bundle into twine.

The tow bundle is then fed through a twisting machine which twists and drafts the bundle to form a twine which is suitable for use in agricultural machines of the type specified.

From the foregoing description it is apparent that the wide range or properties may be incorporated in the finished twine by appropriate modification of the process described above. Incorporating other lubricants and additions in the lubricating bath may produce the desirable end properties in the twine which are not achieved with the relatively inexpensive ethylene glycol solution described above.

It has been found that the treatment of the fibrous material with the caustic solution strengthens the fibres as well as serving to separate the fibers from the vegetable matter binding them together. It is believed that the strengthening of the fibres by the caustic solution may be related to the strengthening which is achieved in the processing of cotton by the mercerizing operation.

Manufacturers often pass the cotton cloth through a strong solution of sodium hydroxide to add luster to the cloth and make it stronger. The precise action which tends to improve the strength of the fibrous material embodied in the present invention is not part of the present invention, except insofar as it contributes to the effectiveness of the end product which is achieved by the present invention.

The twine produced in accordance with the present invention is characterized by a coarser texture than the conventional binder twine produced from imported fibers, but has a strength and durability comparable to twines of similar thickness made with imported fibers. The tow bundle existing from the carding machine is comparable to tow bundles of jute and sisal and the bundles may be twisted into twine using conventional twisting and drafting machines.

Thus, the present invention provides a twine which is produced from domestic products which are plentiful in the particular area where the twine is needed, and the processing of the material into twine may be accomplished with standard machinery which is readily available within the United States and is capable of mass production techniques.

While the preferred embodiment of the invention involves the extraction of fibres from corn husks and leaves for purposes of making twine, it is to be understood that the invention contemplates uses of the extracted fibres for other purposes.

Without further elaboration, the foregoing will so fully illustrate our invention that others may, by applying current or future knowledge, readily adapt the same for use under various conditions of service.

What is claimed as the invention is:

1. A twine adapted for use in baling and binding agricultural product comprising a twisted bundle of fibres which have been separated from a material selected from the group consisting of corn husks and leaves and mixtures thereof, which have been subjected to a caustic solution to free said fibres from the vegetable matter naturally binding said fibres.

2. A twine according to claim 1, wherein said fibrous components are provided with a lubricant of ethylene glycol.

* * * * *